United States Patent [19]

Morse

[11] Patent Number: 4,685,418

[45] Date of Patent: Aug. 11, 1987

[54] POWDER REINFORCING MACHINE

[75] Inventor: Albert I. Morse, Beverly, Mass.

[73] Assignee: USM Corporation, Farmington, Conn.

[21] Appl. No.: 839,846

[22] Filed: Mar. 14, 1986

[51] Int. Cl.[4] ..... B05C 13/00; B05C 13/02

[52] U.S. Cl. ..... 118/503; 156/556; 269/130; 269/131; 269/132

[58] Field of Search ..... 12/61 R; 156/556; 269/130, 131, 132; 118/503

[56] References Cited

U.S. PATENT DOCUMENTS

| | | | |
|---|---|---|---|
| 2,528,491 | 11/1950 | Bradley et al. | 12/61 R |
| 4,480,581 | 11/1984 | Simmonds, Jr. et al. | 118/59 |
| 4,503,091 | 3/1985 | Elliott et al. | 118/503 |

*Primary Examiner*—Sam Silverberg
*Assistant Examiner*—Terry J. Owens
*Attorney, Agent, or Firm*—Spencer T. Smith

[57] ABSTRACT

A machine is disclosed for depositing powder in a selected configuration, fusing the configured powder into a laminate and adhering the fused laminate to a shoe substrate. The machine includes a mounting plate on which the shoe substrate is to be releasably clamped which is elevated from a lower release position to an upper clamping position. A pair of lever arms are mounted on either side of the mounting plate for displacement from a release position to a clamping position. Each lever arm includes a support arm which is configured so that a support portion will be parallel to and lower than the mounting plate when the mounting plate is in the clamping position. A belt is stretchably secured between the support portions with the support portions being selectively located so that when the lever arms are at the release position at least the front portion of the belt will be elevated above the mounting plate thereby permitting the loading or unloading of a shoe substrate on or from the mounting plate and so that when the lever arms are displaced to the clamping position, the belt will forcefully engage the mounting plate whereby a shoe part can be releasably clamped therebetween.

6 Claims, 5 Drawing Figures

POWDER REINFORCING MACHINE

The present invention relates to machines which deposit powder in a selected configuration, fuse the configured powder into a laminate and adhere the fused laminate to a shoe substrate to reinforce the substrate, and more particularly, to substrate clamping mechanisms for such machines.

Shoe substrates take many forms and it is an object of the present invention to provide a clamping mechanism which can be utilized to clamp a great variety of shoe substrates.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

In state of the art powder deposition machines, a rotatable transfer cube 10 having four planar surfaces 12 sequentially indexes a clamped shoe part 14 (FIG. 3) from the top horizontal clamp/unclamp position, counterclockwise through a vertical ready position to a lower horizontal substrate receiving position and then back through the second vertical position to the clamp-/unclamp position.

Figure 2:
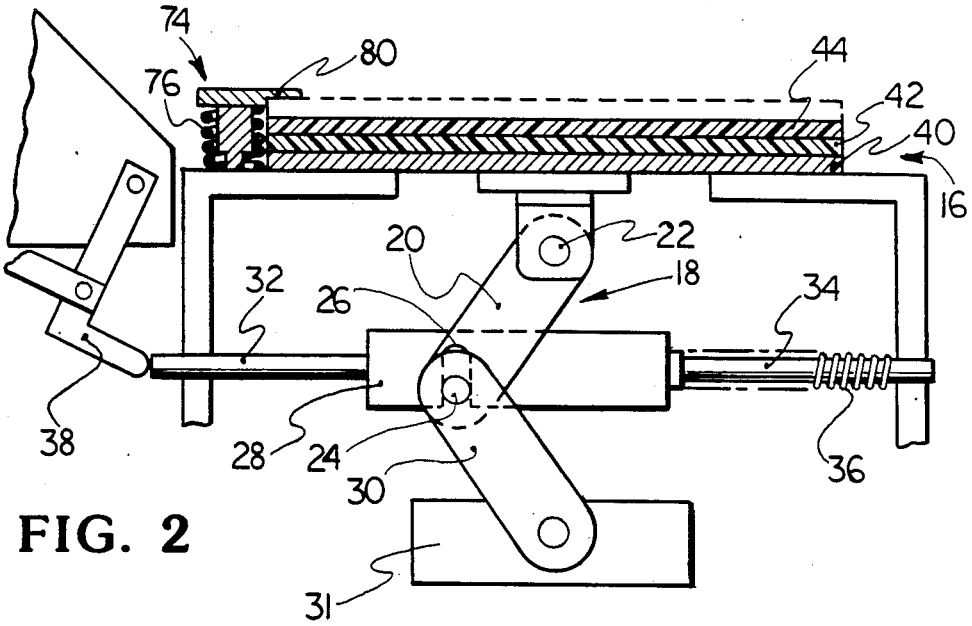
FIG. 2 is a view of the transfer cube illustrated in FIG. 1 taken along lines 2—2 thereof.

A mounting plate 16 is reciprocably displaceable on the outside of each planar face 12 of the transfer cube 10 by a cam arrangement 18 (FIG. 2) which includes a first lever 20 having one end pivotally secured to a stud 22 attached to the middle of the inwardly directed side of the mounting plate 16. The other end of this lever is bifurcated and a pin 24 extends through the tines into a slot 26 cut into the inner sidewalls of a block 28. A second lever 30 has one end pivotally arranged on the block control pin 24 and is hingedly attached at its other end to a central mount 31 anchored within the cube. A rod 32, which is journalled rearwardly through the backside of the cube abuts against the rear surface of the block 28, and a second rod 34 is disposed against the front of the block 28 and has a spring 36 located around the rod between the block and the transfer cube to bias the block 28 to the left or in the unclamping direction. The block 28 is held in the advanced clamping position except when the mounting plate 16 is at the top illustrated position where the rod 24 clears a rub ring (not shown) and is displaced to the left, as shown, to lower the mounting plate 16 to the unclamp position against the front portion of a driver mechanism 38. Further details of this transfer cube are shown in U.S. Pat. No. 4,480,581.

Figure 1:
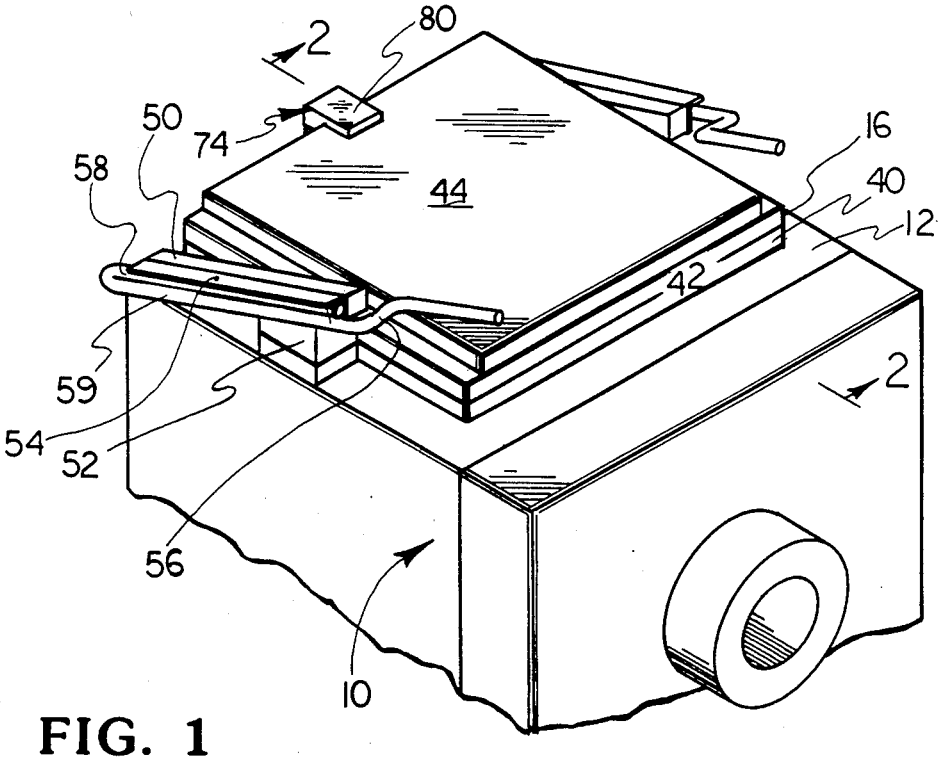
FIG. 1 is a perspective view of the uppermost face of a rotatable transfer cube of a machine which will deposit powder, fuse the powder into a laminate and adhere the fused laminate to a shoe substrate.
Figure 3:
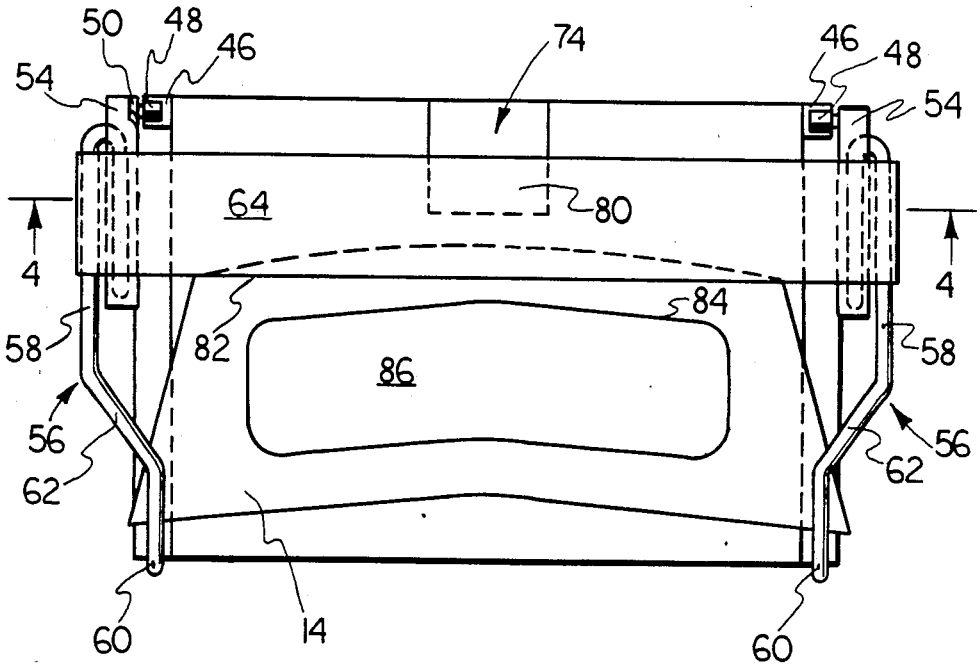
FIG. 3 is a top view looking down on the uppermost face illustrated in FIG. 1 with a shoe part clamped in position.
Figure 4:
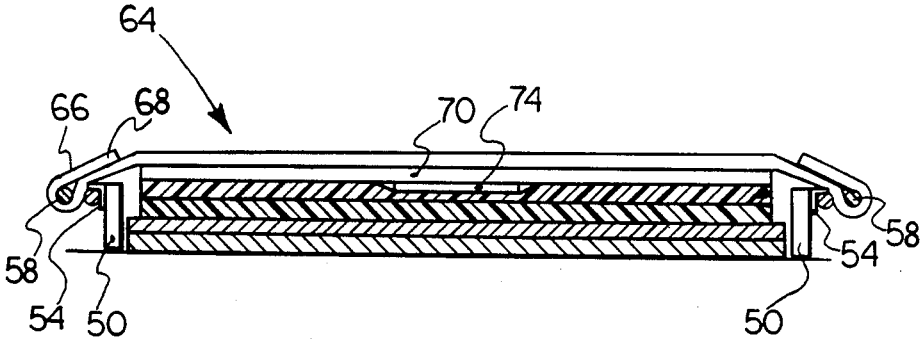
FIG. 4 is a view taken at 4—4 of FIG. 3 illustrating the clamping mechanism in the clamped position.

The mounting plate 16 includes a metallic base plate 40, a central layer 42 of relatively soft resilient material and a top layer 44 of firmer resilient material. Extending horizontally from either side of the base plate 40 are a pair of tabs 46 (FIG. 3). Each tab 46 engages a wheel 48 rotatably mounted on the rearward end of a clamping lever 50 which is pivotally mounted on the post of a mounting bracket 52 secured to the transfer cube face 12. A spring (not shown) extending between the mounting bracket 52 and the clamping lever 50 permanently biases each wheel against its associated tab 46. Displacement of the mounting plate 16 from the lower position to the upper position accordingly controls the movement of the clamping levers 50 from a release position illustrated in FIGS. 1 and 2 to a clamping position shown in FIGS. 3 to 5. A support arm bracket 54 is secured to each clamping lever 50 and is displaceable with the clamping lever 50 from a clamping position parallel to the mounting plate 16 to an upwardly inclined, unclamped position. Secured to each support arm bracket 54 is a support arm 56. The rear portion of the support arm has a U-shaped form with one leg 58 secured to the bracket and the second leg 59 extending parallel to and spaced from the support arm bracket 54. This portion 59 extends substantially from the rear of the mounting plate 16 and is joined to a front substrate engaging portion 60 by a bend 62. The front portion 60 of the second leg is adapted to locate a corner of the shoe part 14 that extends beyond the top layer 44 of the mounting plate 16 between the mounting plate 16 and the support arm 56.

Extending between the rear portions of the second leg of each 59 of the support arms 56 is a clamp down belt 64 made from rubber or the like. The clamp down belt 64 has looped over ends 66 which are slid onto the the support arms. These loops 66 may be defined with adhesive or stitching 68. Secured by adhesive to the lower surface of the clamp down belt 64 and extending from one side of the upper layer 44 to the other is a strip of shim stock 70. The clamp down belt 64 is stretched when positioned on the rear portions 58 of the support arms 56 and is lifted away from the top layer 44 of the mounting plate 16 by the support arms 56 when the mounting plate 16 is lowered to its unclamp position.

An inverted "L" shaped member 74 is disposed on a stud 76 and is biased away from the mounting plate 16 by a spring 78. When the mounting plate 16 is raised to the clamp position, the top 80 of this member forcefully engages the top layer 44 of the mounting plate 16, and when the mounting plate 16 is lowered, the top 80 of this member becomes spaced from this surface and raises the shim stock 70, and hence, the belt 64 which extends over this member 80.

As can be seen from FIG. 3, the rearmost portion of a shoe part 14 will be clamped between the belt 64 and the upper layer 44 of the mounting plate 16. The forward edge 82 of the belt 64 (and shim 70) is located rearwardly of the rearwardmost edge 84 of the fused powder laminate 86 which will be adhered to the shoe part 14. The forwardmost portion of the shoe part is larger than the uppermost layer 44 of the mounting plate 16 and extends at the side of the mounting plate 16 between the forwardmost portions 60 of the support arms 56 and the mounting plate 16.

Figure 5:
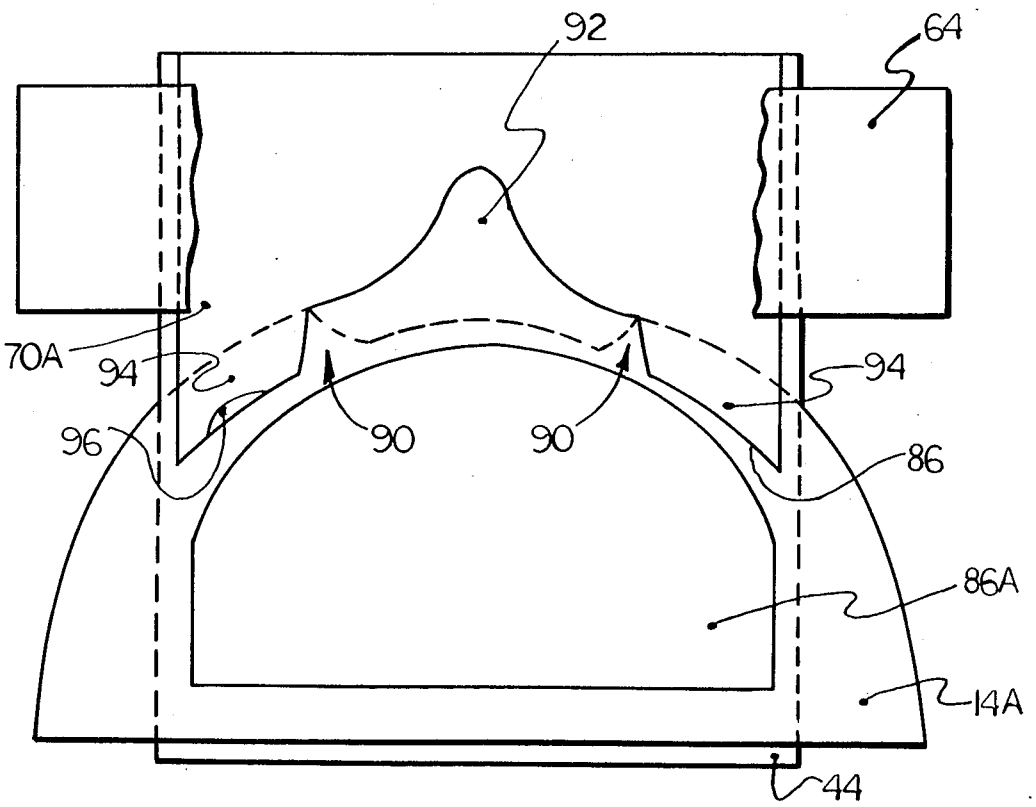
FIG. 5 is a top view illustrating another embodiment of the belt of the disclosed clamping mechanism.

FIG. 5 illustrates the clamping of another shoe part 14A. As illustrated, the part has been reinforced with a fused laminate 86A and is ready for removal from the transfer cube. Here, the shim 70A extends forwardly beyond the rubber belt 64 and has been cut to have an arcuate surface 86 with two symmetrical notches 90.

The shoe part 14A has been located with the rear central portion 92 over the belt 64, and with the rear side portions located underneath the forwardly extending shim portions 94 with the transition taking place at the symmetrical notches 90. The notches 90 function to stop the rearward insertion of the shoe part at the desired location when the belt is raised and to additionally provide visual markers to assist in the central location of the shoe part 14A. To enhance the gripping of the belt, emery cloth 96 or other abrasive material may be secured to the lower surface of these forwardly extending portions 94 of the shim 70A.

What is claimed is:

1. A machine for depositing powder in a selected configuration, fusing the configured powder into a laminate and adhering the fused laminate to a shoe substrate comprising a transfer structure including at least one face adapted to be rotated from a load position to a laminate adhering position, mounting plate means on which the shoe substrate is to be releasably clamped, means for elevating said mounting plate means from a lower release position resting on said face to an upper clamping position, a pair of lever arm means, bracket means secured to said transfer structure face for mounting one of said pair of lever arm means one on each side of said mounting plate means for displacement from a release position to a clamping position, said mounting plate means including means for displacing each of said lever arm means from said release position by said clamping position, each of said lever arm means including a support arm, configured so that a support portion will be parallel to and lower than said mounting plate means when said mounting plate means is in said clamping position, and belt means secured to and stretchably secured between said support portions of said lever arm means, said support portions being selectively located so that when said lever arm means are at said release position at least the front portion of said belt means will be elevated above said mounting plate means thereby permitting the loading or unloading of a shoe substrate on or from said mounting plate means and so that when said lever arm means are displaced to the clamping position, said belt means will forcefully engage said mounting plate means whereby a shoe part can be releaseably clamped therebetween.

2. A machine according to claim 1, further comprising tab means including a tab having a top face and being mounted on said transfer structure face so that said tab top face is located between a rear portion of said belt means and said mounting plate means so that when said mounting plate means is in said clamping position, said tab top face engages said mounting plate means, and when said mounting plate means is in said release position, said tab means top face engages said belt means and raises said belt means to a position apart from said mounting plate means.

3. A machine according to claim 1, wherein said belt means comprises a rubber belt having a metallic strip secured to the central portion thereof.

4. A machine according to claim 3, wherein said metallic strip includes stop means for selectively limiting the rearward insertion of a shoe part onto said mounting plate means.

5. A machine according to claim 4, wherein said stop means comprises symmetrical notch means defined in the forward edge of said metallic strip.

6. A powder reinforcing machine according to claim 5 further comprising abrasive means secured to the underneath surface of a frontmost portion of said metallic strip.

* * * * *